US010161157B2

(12) United States Patent
Grahn

(10) Patent No.: US 10,161,157 B2
(45) Date of Patent: Dec. 25, 2018

(54) TENT FRAME AND A TENT

(71) Applicant: Tentipi AB, Moskosel (SE)

(72) Inventor: Bengt Grahn, Sunne (SE)

(73) Assignee: Tentipi AB, Moskosel (SE)

( * ) Notice: Subject to any disclaimer, the term of this patent is extended or adjusted under 35 U.S.C. 154(b) by 0 days.

(21) Appl. No.: 15/512,921

(22) PCT Filed: Sep. 23, 2014

(86) PCT No.: PCT/SE2014/051088

§ 371 (c)(1),
(2) Date: Mar. 21, 2017

(87) PCT Pub. No.: WO2016/048201

PCT Pub. Date: Mar. 31, 2016

(65) Prior Publication Data

US 2017/0247904 A1 Aug. 31, 2017

(51) Int. Cl.

| | |
|---|---|
| ***E04H 15/24*** | (2006.01) |
| ***E04H 15/16*** | (2006.01) |
| ***E04H 15/48*** | (2006.01) |
| ***E04H 15/54*** | (2006.01) |

(52) U.S. Cl.

CPC ..... *E04H 15/24* (2013.01); *E04H 15/16* (2013.01); *E04H 15/48* (2013.01); *E04H 15/54* (2013.01)

(58) Field of Classification Search

CPC ..... E04H 15/48; E04H 15/34; E04H 15/54; E04H 15/16; E04H 15/24; E04H 15/32; E04H 15/60; E04H 15/001; Y10T 403/7194; Y10T 403/70

USPC ..... 135/99, 100, 121, 135, 143–144, 120.3, 135/147; 403/217–219, 400

See application file for complete search history.

(56) References Cited

U.S. PATENT DOCUMENTS

| | | | | | |
|---|---|---|---|---|---|
| 2,302,650 | A | * | 11/1942 | Anderson | E04H 15/00 135/100 |
| 2,818,875 | A | * | 1/1958 | Denn | B23K 1/00 135/100 |
| 2,967,534 | A | * | 1/1961 | Silye | E04H 15/48 135/100 |
| 3,004,542 | A | * | 10/1961 | Moody | E04B 1/34326 135/100 |
| 3,039,478 | A | | 6/1962 | Timmons | |

(Continued)

FOREIGN PATENT DOCUMENTS

| | | | |
|---|---|---|---|
| AU | 4124272 | A | 10/1973 |
| DE | 295 12 811 | U1 | 9/1995 |

(Continued)

*Primary Examiner* — Winnie Yip

(74) *Attorney, Agent, or Firm* — Dilworth & Barrese, LLP

(57) ABSTRACT

A tent frame (1) for carrying a tent cloth comprises at least four rods (2) each configured to have one end (3*a*) resting on a ground, to extend from that end convergingly towards a top of a said tent and to carry a tent cloth bearing outside thereon, and an arrangement (6) configured to interconnect said rods (2) so as to hold them in a determined mutual position. Said arrangement (6) comprises, for each pair of adjacent rods (2*a-b*), at least one rigid elongated element (7) and at least two elongated members so as to provide support for holding said rigid elongated element (7) between the adjacent rods (2*a-b*) and these in a said determined mutual position.

20 Claims, 3 Drawing Sheets

(56) References Cited

U.S. PATENT DOCUMENTS

| | | | | | |
|---|---|---|---|---|---|
| 3,488,901 | A * | 1/1970 | Peterschmidt | E04B 1/3211 | 52/462 |
| 3,502,091 | A * | 3/1970 | Corbin | E04H 15/18 | 135/100 |
| 4,066,089 | A | 1/1978 | Rainwater | | |
| 4,074,682 | A * | 2/1978 | Yoon | E04H 15/48 | 135/135 |
| 4,505,609 | A | 3/1985 | Vella | | |
| 4,838,292 | A | 6/1989 | Allen | | |
| 5,439,016 | A * | 8/1995 | Grahn | E04H 15/24 | 135/100 |
| 5,797,695 | A | 8/1998 | Prusmack | | |
| 7,172,512 | B2 * | 2/2007 | Be | A63G 9/12 | 135/135 |
| 7,900,646 | B2 * | 3/2011 | Miller | E04H 15/44 | 135/120.3 |
| D729,378 | S * | 5/2015 | Autrey | D23/398 | |
| 9,631,394 | B2 * | 4/2017 | Grahn | E04H 15/34 | |
| 2015/0068117 | A1 * | 3/2015 | Savino | A01G 9/128 | 47/45 |

FOREIGN PATENT DOCUMENTS

| | | | |
|---|---|---|---|
| DE | 195 30 730 | A1 | 2/1997 |
| EP | 579 663 | B1 | 2/1997 |
| KR | 2011-81449 | A | 7/2011 |
| WO | 92/18729 | A1 | 10/1992 |

* cited by examiner

TENT FRAME AND A TENT

TECHNICAL FIELD OF THE INVENTION

The present invention relates to a tent frame for carrying a tent cloth, comprising at least four rods each configured to have one end resting on a ground, to extend from that end convergingly towards a top of a said tent and to carry a tent cloth bearing outside thereon, and an arrangement configured to interconnect said rods so as to hold them in a determined mutual position, said arrangement comprising, for each pair of adjacent rods, at least one rigid elongated element configured to interconnect a first rod with a second rod of a pair of adjacent rods, as well as a tent provided with such a tent frame.

Such a tent frame may be used for various types of tents, but the present invention is especially directed to such tent frames for tents having a tapered shape or at least the lower part thereof with the shape of a lower part of a tapered body such as a cone or a tapered square. Typical tents of this type are huts and tepees. Thus, "extend from that end convergingly" does not mean that said rods has to meet at the top of such a tent frame, but the upper ends of the rods may have a considerable mutual distance to each other, and the top of the tent may for instance be flat or make another considerable angle with respect to the extension of said rods.

The invention relates to such tent frames for tents of a variety of different seizes, from smaller tents which may have a top height and base diameter in the region of 2 and 3.5 meters, respectively, to larger so-called "giant tepees", which may have a top height and base diameter rather often in the region of 8 and 11 meters, respectively. Such tents may be used for temporary use by private campers, scouts, school classes or sport clubs, or for permanent use as warming huts at ski resorts, as a few examples.

BACKGROUND ART

A tent frame of the type defined in the introduction is known through for example EP 0 579 663 B1. Although the tent frame disclosed in that publication is well-functioning for its purpose, there is a desire to simplify the structure of tent frames of this type so as to be able to provide a tent provided with such a tent frame that is more cost-efficiently to produce and easier for a user to handle.

SUMMARY OF THE INVENTION

The object of the present invention is to provide a tent frame of the type defined in the introduction being more cost-effective to produce and easier for a user to handle with respect to such tent frames already known.

This object is according to the invention obtained by providing such a tent frame with a said arrangement further comprising, for each pair of adjacent rods, at least two elongated members each configured to be removably received in a through-hole in said first and second rod, respectively, and to protrude therefrom on both sides of the respective through-hole, and at least one said rigid elongated element which is provided with a first recess in a first end thereof and a second recess in a second end thereof, said first recess being configured to receive and interact with a said elongated member received in a through-hole in said first rod and said second recess being configured to receive and interact with a said elongated member received in a through-hole in said second rod so as to provide support for holding said rigid elongated element between said first and second rod and these in a said determined mutual position.

The features of such an arrangement according to the invention for interconnecting said rods so as to hold them in a determined mutual position results in a tent frame being extremely cost-efficient to produce due to its uncomplicated structure and basic components. Additionally, the simplified structure of such a tent frame makes it easy for a user to mount and disassemble a tent provided with this. The low cost and easy handling of such a tent enlarges the target group of users.

According to an embodiment of the invention said at least two elongated members are flexible members and each said first and second recesses in said rigid elongated element extends from a first end surface and a second end surface of said rigid elongated element, respectively, along the longitudinal extension and inside of said rigid elongated element in such a way that said first and second recess is configured to receive a protruding end portion of said flexible elongated member received in a through-hole in said first rod and a protruding end portion of said flexible elongated member received in a through-hole in said second rod, respectively. Such recesses in a said rigid elongated element in combination with the flexible elongated members enable uncomplicated mounting of the rigid elongated element between two said rods.

According to another embodiment of the invention each of said first and second recesses is a hole with a bottom, said bottom giving each of said first and second recesses a depth that together with the thickness of a said rod is at least one, preferably at least two, length-units smaller than the length of a said flexible elongated member, said length-unit corresponding to the thickness of a said rigid elongated element. Said recesses being a hole with a bottom with such a depth prevents a flexible elongated member, received in a through-hole in a said rod and supporting a said rigid elongated element on each side of the through-hole, from being moved into one of said rigid elongated elements so far that it loses its interaction with the rigid elongated element on the opposite side of said rod. This results in a steady arrangement of a said rigid elongated element between two said rods.

According to another embodiment of the invention the sum of said depth of a said recess in a said rigid elongated element, supported by a said flexible elongated member, the thickness of a said rod and a said depth of a said recess of another said rigid elongated element, supported by the same flexible member, is equal to or larger than the length of said flexible elongated member. This ensures that every said rigid elongated element will be held between two said rods in such a way that the first and second end surfaces of the rigid elongated element will abut an outer surface of these rods, respectively, resulting in a stable structure of the tent and eliminating the risk of wobbling parts.

According to another embodiment of the invention said at least two elongated members are hard members, so that they protrude substantially perpendicularly to the extension of a said rod when received in a said through-hole of that rod. The feature of hard elongated members received in said recesses in said rigid elongated elements ensures a stable support of the latter, so that a user may lean on, or even hang in, a said rigid elongated element without that the elongated members supporting this will bend so much that they slip out of the recesses and the rigid elongated element falls out of its position.

According to another embodiment of the invention said at least two elongated members are metal wires, preferably steel wires. Metal wires, especially steel wires, have suitable characteristics to be used as said elongated members, as they are flexible and still hard.

According to another embodiment of the invention said at least four rods are made of wood. Wood is a cheap, still steady material which is well suited for this purpose. Such rods made of wood may even be made of tree trunks by the user, in advance or at the location of mounting the tent.

According to another embodiment of the invention said at least one rigid elongated element provided with said recesses is made of wood.

According to another embodiment of the invention said arrangement further comprises a top module configured to interconnect the ends of said at least four rods opposite to said ends configured to rest on a ground, at the top of said tent.

Such a top module improves the stability of the tent and assists said rigid elongated elements in holding said rods in a determined mutual position.

According to another embodiment of the invention said top module comprises a body and a holding member fixedly secured to the body and provided with at least four sleeves configured to receive a said end of said at least four rods opposite to said ends configured to rest on a ground, respectively. Such a top module having said at least four rods contributes to easy mounting of the tent frame and is especially suitable for users making their own rods.

According to another embodiment of the invention said holding member has an annular shape.

According to another embodiment of the invention each of said at least four sleeves is arranged at least partially pivotable about an axis extending in parallel with the extension of a ground on which said at least four rods are configured to rest. Such an arrangement of the sleeves provides the possibility for a user to adjust the height and diameter of the tent, and also contributes to easy mounting of the tent frame, even when said rods are very long.

According to another embodiment of the invention each of said at least four sleeves is arranged at least partially movable along a frame of the holding member thus along the extension of a plane, said plane extending in parallel with the extension of a ground on which said at least four rods are configured to rest. This feature enables adjustment of the number and position of said rods according to the tent cloth used and also simplifies the mounting of the tent frame, as the rods can be pushed together and thus press the rigid elongated elements between them.

According to another embodiment of the invention each said sleeve is provided with a securing member configured to removably secure a said end of a said rod after introduced in the respective sleeve. Such sleeves prevent said rods from slipping out of the respective sleeves, resulting in a safe usage of the tent.

According to another embodiment of the invention said top module is made mainly of metal. Such a top module made of metal improves the stability and also prolong the life of the tent.

According to another embodiment of the invention the tent frame comprises at least five said rods.

The invention also relates to a tent having a tent frame according to the present invention.

Further advantages as well as advantageous features of the invention will appear from the following description.

BRIEF DESCRIPTION OF THE DRAWINGS

With reference to the appended drawings, below follows a specific description of an embodiment of the invention cited as an example.

In the drawings.

DETAILED DESCRIPTION OF AN EMBODIMENT OF THE INVENTION

Figure 1:
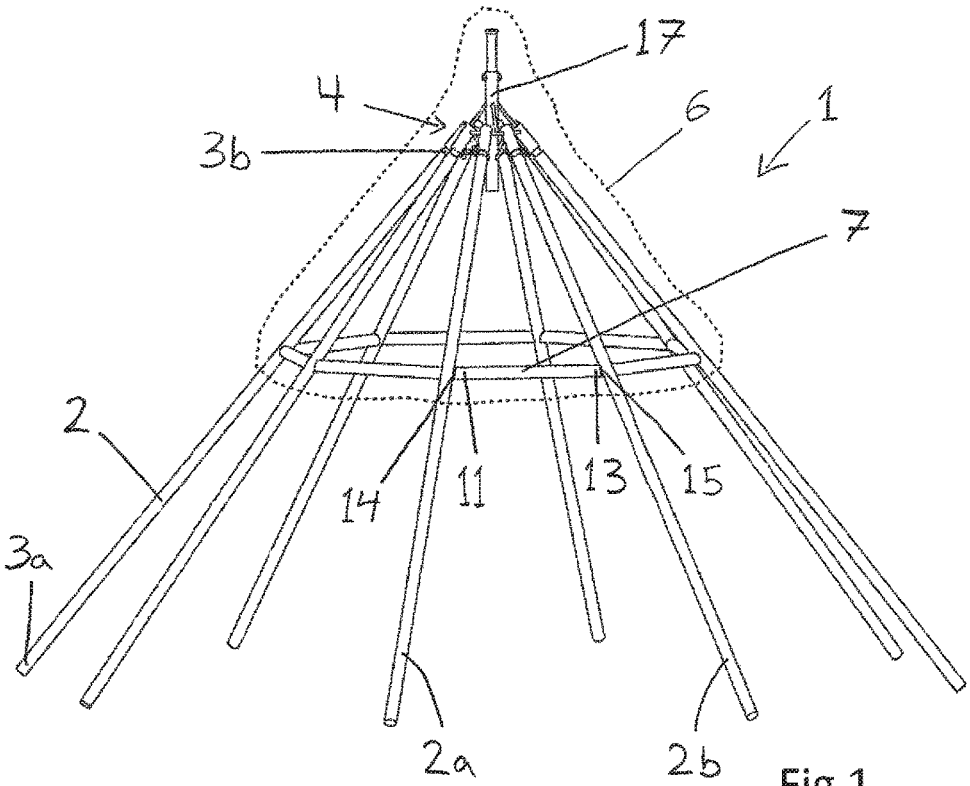
FIG. 1 is a simplified view obliquely from above of a tent frame according to an embodiment of the invention with said arrangement schematically indicated.
Figure 2:
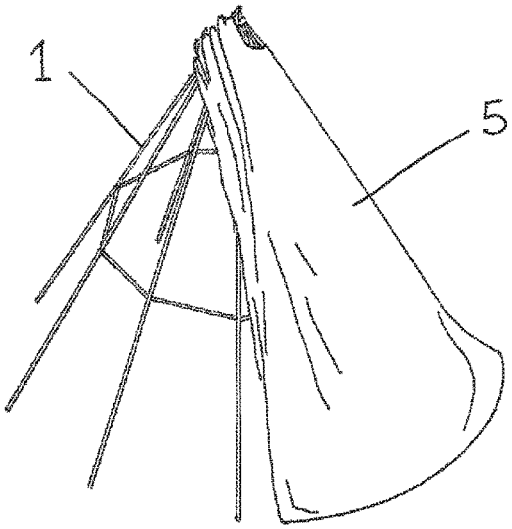
FIG. 2 is a view obliquely from above of the tent frame of FIG. 1 with a tent cloth carried on half of the tent frame.

A tent frame 1 according to an embodiment of the invention is shown in FIGS. 1 and 2 and comprises eight rods 2 each configured to have one end 3*a* resting on a ground, to extend from that end convergingly towards a top 4 of the tent frame and to carry a tent cloth 5 (see FIG. 2) bearing outside thereon. The rods 2 extend to form a frame of a substantially cone-shaped tent, such as a tepee.

The tent frame 1 has an arrangement 6 configured to interconnect the rods 2 so as to hold them in a determined mutual position. This arrangement comprises at about half of the height of the tent frame, for each pair of adjacent rods, one rigid elongated element 7 configured to interconnect a first rod 2*a* with a second rod 2*b* of a pair of adjacent rods, two flexible elongated members 8 each configured to be removably received in a through-hole 9 in said first and second rod, respectively, and to protrude therefrom on both sides of the respective through-hole.

Figure 3:
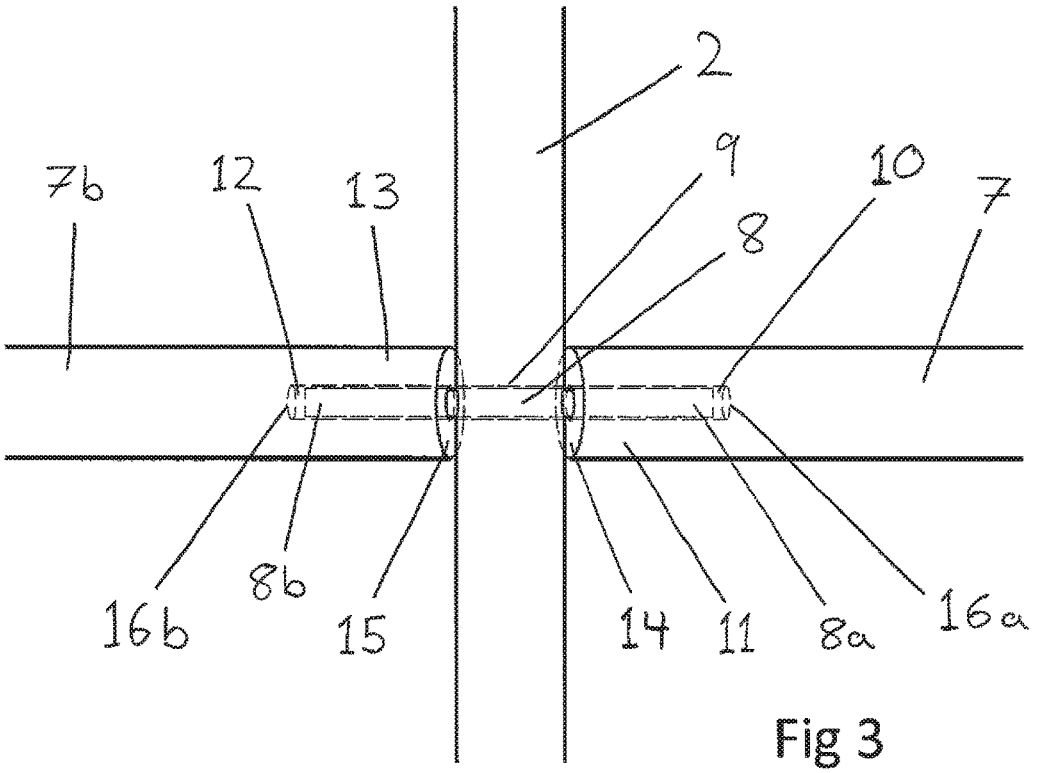
FIG. 3 is an enlarged simplified side view showing partially in transparency a part of said arrangement of the tent frame shown in FIG. 1 with a said rod with a said flexible elongated member received in a through-hole thereof and protruding therefrom for supporting a rigid elongated element on each side of the through-hole.
Figure 4:
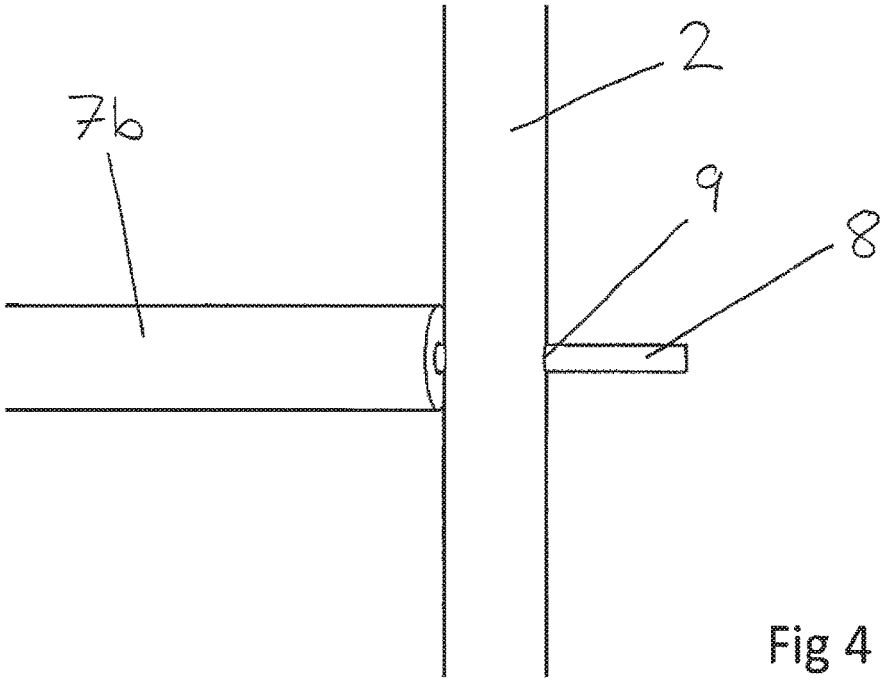
FIG. 4 is a view corresponding to FIG. 3 with one of the two rigid elongated elements removed.

The connection between the rigid elongated elements 7 and the rods 2 is shown in FIGS. 3 and 4. A rigid elongated element 7 is provided with a first recess 10 in a first end 11 thereof and a second recess 12 in a second end 13 thereof. Said second recess in said second end of the rigid elongated element 7 is not shown in FIG. 3, but corresponds to the second recess 12 in the second end 13 of the adjacent rigid elongated element 7*b* shown in said Figure. Each recess is a hole that extends from a first end surface 14 and a second end surface 15 of said rigid elongated element 7, respectively, along the longitudinal extension and inside of said rigid elongated element to a respective bottom 16*a-b* therein. The first recess 10 is configured to receive and interact with a said flexible elongated member 8 received in a through-hole 9 in said first rod 2*a* and the second recess 12 is configured to receive and interact with a said flexible elongated member 8 received in a through-hole 9 in said second rod 2*b* so as to provide support for holding said rigid elongated element 7 between said first and second rod and these in a said determined mutual position.

The through-holes 9 and the recesses 10, 12 have slightly larger diameters than the flexible elongated members 8, so as to allow said members to be easily inserted without being too movable therein.

The bottom 16*a-b* gives each of said first 10 and second 12 recesses a depth that together with the thickness of the rod 2 is at least one, preferably at least two, length-units smaller than the length of a said flexible elongated member 8, said length-unit corresponding to the thickness of a said rigid elongated element 7. Moreover, the sum of said depth of a said recess 10 in a said rigid elongated element 7, supported by a said flexible elongated member 8, the thickness of a said rod 2 and a said depth of a said recess 12 of another said rigid elongated element, supported by the same flexible member 8, is equal to or larger than the length of said flexible elongated member.

These proportions ensure that a flexible elongated member 8 received in a through-hole 9 of a said rod 2 (see FIG. 3) is long enough to support both rigid elongated elements 7, 7*b* even when it is moved into any recess 10, 12 so far that it abuts the bottom 16*a-b* therein, and simultaneously the flexible elongated member 8 is not that long that it prevents the first 14 and second 15 end surfaces of the rigid elongated elements 7, 7*b* supported thereby to abut the outer surface of the rod 2.

The flexible elongated members 8 are in this embodiment hard members, so that they protrude substantially perpendicularly to the extension of a said rod 2 when received in a said through-hole 9 of that rod (see FIG. 4). Steel wires have advantageous characteristics for use as said flexible elongated members.

The rods 2 and the rigid elongated elements 7 are preferably made of a material that is stiff and stable still having a low weight, such as wood or aluminium.

Figure 5:
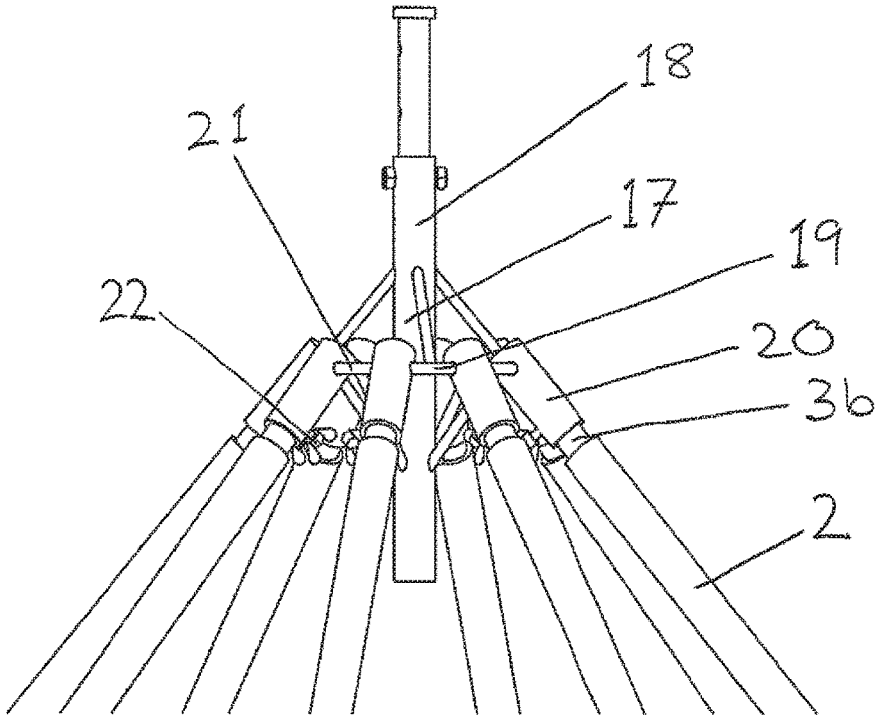
FIG. 5 is an enlarged side view of the top of the tent frame shown in FIG. 1 showing a said top module and eight said rods interconnected therethrough.
Figure 6:
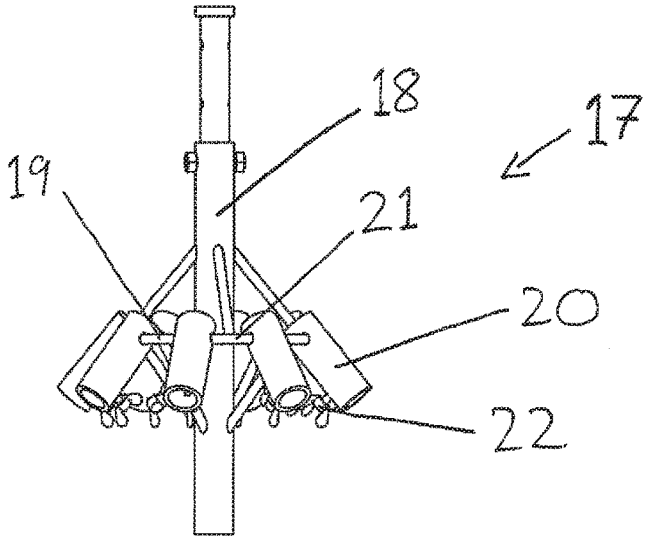
FIG. 6 is a side view of the top module shown in FIG. 5 without said rods.

The arrangement 6 also comprises a top module 17, as is shown in FIGS. 5 and 6, located at the top 4 of the tent frame 1 and configured to interconnect the ends 3*b* of said rods 2 opposite to said ends 3*a* configured to rest on a ground. The top module comprises a body 18 and an annular shaped holding member 19 fixedly secured to the body and provided with eight sleeves 20 each configured to receive a said end 3*b* of one of said eight rods 2 opposite to said ends 3*a* configured to rest on a ground.

Each sleeve 20 is arranged pivotable about an axis extending in parallel with the extension of a ground on which the rods 2 are configured to rest and also at least partially movable along a frame 21 of the holding member 19 and thus along the extension of a plane, said plane extending in parallel with the extension of a said ground. Each sleeve 20 is provided with a securing member 22 configured to removably secure a said end 3*b* of a said rod 2 after this has been introduced in the respective sleeve. The securing members are here screws but may also be for example springs or expansion plugs.

The top module 17 is made mainly of a hard and stiff material for providing a stable connection of the rods 2 resulting in a stable tent frame 1. However, the material of the top module may vary according to the use of a tent provided with such a top module. A light-weight material, such as a hard plastic, is suitable for tents that are often moved to other locations and a more stable but heavier material, such as a metal, could be suitable for a permanently standing tent, as a few examples.

Hereinafter follows a simplified description of how a tent provided with a tent frame according to the invention may be used.

A user either buys a top module 17, flexible elongated members 8, such as rather short pieces of steel wires, and a tent cloth 5 and simply brings this together with tools to make his own said rods 2 and rigid elongated elements 7 to the location for mounting the tent, or buys the complete tent with rods and rigid elongated elements included. A saw, a drilling machine and a knife could be suitable tools for making rods and rigid elongated elements out of wooden trunks and sticks.

When mounting the tent frame 1 the top module 17 is placed on a ground and said ends 3*b* of a preferable number of rods 2 are inserted in the respective sleeves 20 arranged at the holding member 19 of the top module so that the ends 3*a* of the rods configured to be placed on a ground are pointing in evenly distributed directions from the centre of the top module 17. Said ends 3*a* are then lifted from the ground and pushed towards each other so that the top module is lifted in the air to a suitable position and the ends 3*a* are placed on the ground. The tent frame 1 has at this point the shape of a traditional tepee without the tent cloth 5, but is quite unstable.

The flexible elongated members 8 are each inserted in a through-hole 9 of a respective rod 2 so that they protrude to about the same length on both sides of the respective through-hole. To arrange a rigid elongated element 7 between a pair of adjacent rods 2*a-b* the flexible elongated member 8 received in a first rod 2*a* is inserted in a first recess 10 at one end 11 of the element and a flexible elongated member received in a second rod 2*b* is inserted in a second recess 12 at the opposite second end 13 of the element whereby said element 7 is supported and held by the flexible elongated members 8. The first and second rods are then pushed together so that the first 14 and second 15 end surface of that rigid elongated element abuts an outer surface of the first 2*a* and second 2*b* rod, respectively. This method is repeated until every pair of adjacent rods is interconnected through a said element 7. The rods 2 are in this way held in a determined mutual position by the arrangement 6 and said mutual position is accordingly defined by the length of the rigid elongated elements. With support of said elements the tent frame is now as stable as necessary, to carry the tent cloth 5 and withstand outer forces such as rain, snow and strong winds.

At last the tent cloth 5 is arranged over and carried by the tent frame 1 and the tent is ready to use. If desirable, the tent may of course be provided with an arrangement (not shown in the Figures) for providing a more convenient opening than a passage in the tent cloth. This is common practice in use of such tents.

The invention is of course not in any way restricted to the embodiment described above, but many possibilities to modifications thereof would be apparent to a person skilled in the art without departing from the scope of the invention as defined in the appended claims.

The word "rigid" as used in the phrase "rigid elongated element" is to be interpreted broadly and defines an element that is substantially stiff thereby suitable for being used as a spacer, but could of course be bent to some extent by impact of a considerable force thereon.

The phrase "a pair of adjacent rods" simply refers to two adjacent rods combined. For example, when three rods in a row is considered, the left rod and the middle rod are together one such pair and the middle rod and the right rod are together another such pair. Accordingly, every rod around the periphery of the tent frame will be included in two different such pairs of adjacent rods.

A flexible elongated member could be a member that is completely flexible, such as a rope, but may also be a member that is substantially hard but can be bent to some extent, such as a hard steel wire or a fiberglass rod. In the case of an elongated member being a rope, this have to be stretched or secured in some way. The cross-section of a said elongated member may be of any shape, such as spherical, square etc. Said through-holes and recesses have then preferably the same cross-section as said elongated member.

Each rod may be formed by a plurality of rod pieces connecting to each other for forming a long rod, for instance by being telescopically received in each other. These pieces are then preferably, but not necessarily, of aluminium.

The number of rods comprised in the tent frame may vary from 4 to 10 or more, but are preferably 8 or 9.

A said recess has an opening at a surface but not necessarily a bottom. Accordingly, a said rigid elongated element provided with a recess at each of two opposing end surfaces may for instance be a tube.

A tent frame could have rigid elongated elements interconnecting the rods at more than one height, so that the rods may be interconnected through such elements at two or three levels, for example near the ground, in the middle and near the top of the tent. This is especially useful for larger tents.

The invention claimed is:

1. A tent frame (1) for carrying a tent cloth (5), comprising at least four rods (2) each configured to have one end (3*a*) resting on a ground, to extend from that end convergingly towards a top of a tent and carry a tent cloth (5) bearing outside thereon, and an arrangement (6) configured to interconnect said rods (2) to hold them in a determined mutual position, said arrangement (6) comprising, for each pair of adjacent rods (2), at least one rigid elongated element (7) configured to interconnect a first rod (2*a*) with a second rod (2*b*) of a pair of adjacent rods (2*a-b*), wherein said arrangement (6) further comprises, for each pair of adjacent rods (2*a-b*), at least two elongated members (8), each said elongated member (8) configured to be removably received in and extend entirety through a through-hole (9) in said first (2*a*) and second (2*b*) rod, respectively, and protrude therefrom on both sides of the respective through-hole (9), and at least one said rigid elongated element (7) which is provided with a first recess (10) in a first end (11) thereof and a second recess (12) in a second end (13) thereof, said first recess (10) being configured to receive and interact with said elongated member (8) received in and extending through the through-hole (9) in said first rod (2*a*) by receiving a protruding end portion (8*a*) of said single elongated member (8), and said second recess (12) being configured to receive and interact with said elongated member (8) received in and extending through the through-hole (9) in said second rod (2*b*) by receiving an opposite protruding end portion (8*b*) of said single elongated member (8), to provide support for holding said rigid elongated element (7) between said first (2*a*) and second (2*b*) rods and these rods (2*a*, 2*b*) in a determined mutual position.

2. A tent frame (1) according to claim 1, wherein said at least two elongated members (8) are flexible members, and each said first (10) and second (12) recesses in said rigid elongated element (7) extends from a first end surface (14) and a second end surface (15) of said rigid elongated element (7), respectively, along a longitudinal extension and inside of said rigid elongated element (7).

3. A tent frame (1) according to claim 2, wherein each of said first (10) and second (12) recesses is a hole with a bottom (16*a-b*), said bottom (16*a-b*) giving each of said first (10) and second (12) recesses a depth that, together with the thickness of said rod (2), is at least one, preferably at least two, length-units smaller than the length of said flexible elongated member (8), said length-unit corresponding to the thickness of said rigid elongated element (7).

4. A tent frame (1) according to claim 3, wherein the sum of said depth of said recess (10) in said rigid elongated element (7), supported by said flexible elongated member (8), the thickness of said rod (2) and a depth of said recess (12) of another said rigid elongated element (7*b*), supported by the same flexible elongated member (8), is equal to or larger than the length of said flexible elongated member (8).

5. A tent frame (1) according to claim 1, wherein each of said first (10) and second (12) recesses is a hole with a bottom (16*a-b*), said bottom (16*a-b*) giving each of said first (10) and second (12) recesses a depth that, together with the thickness of said rod (2), is at least one, preferably at least two, length-units smaller than the length of said elongated member (8), said length-unit corresponding to the thickness of said rigid elongated element (7).

6. A tent frame (1) according to claim 5, wherein the sum of said depth of said recess (10) in said rigid elongated element (7), supported by said elongated member (8), the thickness of said rod (2) and a depth of said recess (12) of another said rigid elongated element (7*b*), supported by the same elongate member (8), is equal to or larger than the length of said elongated member (8).

7. A tent frame (1) according to claim 1, wherein the sum of said depth of said recess (10) in said rigid elongated element (7), supported by said elongated member (8), the thickness of said rod (2) and a depth of said recess (12) of another said rigid elongated element (7*b*), supported by the same elongated member (8), is equal to or larger than the length of said elongated member (8).

8. A tent frame (1) according to claim 1, wherein said at least two elongated members (8) are hard members, and protrude substantially perpendicularly to extension of said rod (2) when received in said through-hole (9) of said respective rod (2).

9. A tent frame (1) according to claim 1, wherein said at least two elongated members (8) are metal wires, preferably steel wires.

10. A tent frame (1) according to claim 1, wherein said at least four rods (2) are made of wood.

11. A tent frame (1) according to claim 1, wherein said at least one rigid elongated element (7) provided with said recesses (10, 12) is made of wood.

12. A tent frame (1) according to claim 1, wherein said arrangement (6) further comprises a top module (17) configured to interconnect the ends (3*b*) of said at least four rods (2) opposite to said ends (3*a*) configured to rest on the ground, at the top of said tent.

13. A tent frame (1) according to claim 12, wherein said top module (17) comprises a body (18) and a holding member (19) fixedly secured to the body (18) and provided with at least four sleeves (20) configured to receive said ends (3*b*) of said at least four rods (2) opposite to said ends (3*a*) configured to rest on the ground, respectively.

14. A tent frame (1) according to claim 13, wherein said holding member (19) has an annular shape.

15. A tent frame (1) according to claim 13, wherein each of said at least four sleeves (20) is arranged at least partially pivotable about an axis extending in parallel with an extension of the ground on which said at least four rods (2) are configured to rest.

16. A tent frame (1) according to claim 13, wherein each of said at least four sleeves (20) is arranged at least partially movable along a frame (21) of the holding member (19) and thus along an extension of a plane, said plane extending in parallel with an extension of the ground on which said at least four rods (2) are configured to rest.

17. A tent frame (1) according to claim 13, wherein each said sleeve (20) is provided with a securing member (22) configured to removably secure said end (3*b*) of said rod (2) after introduced in the respective sleeve (20).

18. A tent frame (1) according to claim 12, wherein said top module (17) is made mainly of metal.

19. A tent frame (1) according to claim 1, comprising at least five said rods (2).

20. A tent having a tent frame (1) according to claim 1.

* * * * *